US008474818B2

(12) United States Patent
deJong et al.

(10) Patent No.: US 8,474,818 B2
(45) Date of Patent: Jul. 2, 2013

(54) NIP RELEASE SYSTEM

(75) Inventors: Joannes N. M. deJong, Hopewell Junction, NY (US); Lloyd A. Williams, Mahopac, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/084,272

(22) Filed: Apr. 11, 2011

(65) Prior Publication Data

US 2011/0187046 A1 Aug. 4, 2011

Related U.S. Application Data

(63) Continuation of application No. 12/249,593, filed on Oct. 10, 2008, now abandoned.

(51) Int. Cl.
*B65H 5/02* (2006.01)

(52) U.S. Cl.
USPC ..... 271/273; 271/274

(58) Field of Classification Search
USPC ..... 271/273, 274
See application file for complete search history.

(56) References Cited

U.S. PATENT DOCUMENTS

| | | | | |
|---|---|---|---|---|
| 2,632,641 | A * | 3/1953 | Rice | 226/188 |
| 3,025,055 | A | 3/1962 | Bryant | |
| 3,854,315 | A | 12/1974 | Winkler | |
| 4,228,994 | A | 10/1980 | Volpe | |
| 4,558,373 | A | 12/1985 | Plasencia et al. | |
| 4,630,815 | A * | 12/1986 | Petersen et al. | 271/273 |
| 4,685,664 | A | 8/1987 | Petersdorf | |
| 4,833,989 | A | 5/1989 | Wieland | |
| 4,917,370 | A | 4/1990 | Batts | |
| 4,971,304 | A | 11/1990 | Lofthus | |
| 4,971,311 | A | 11/1990 | Tsukimoto | |
| 5,004,222 | A | 4/1991 | Dobashi | |
| 5,094,442 | A | 3/1992 | Kamprath et al. | |
| 5,167,751 | A | 12/1992 | Shimizu et al. | |
| 5,169,140 | A | 12/1992 | Wenthe, Jr. | |

(Continued)

FOREIGN PATENT DOCUMENTS

| | | | |
|---|---|---|---|
| JP | 60002547 | A | 1/1985 |
| JP | 60082553 | A | 5/1985 |
| JP | 61229748 | A | 10/1986 |
| JP | 63306145 | A | 12/1988 |

OTHER PUBLICATIONS

Karns, Kara L., An Empirical Evaluation of Nip Mechanics as it Impacts Paper Drive Variability in a Copy Registration System, Xerox InternalReport Data Sheet, Accession No. X9500117, Issued May 9, 1995.

*Primary Examiner* — Luis A Gonzalez
(74) *Attorney, Agent, or Firm* — Fox Rothschild LLP

(57) ABSTRACT

Methods and system for reducing sheet skew in a sheet transport system are disclosed. A sheet transport system may include an idler wheel, a drive wheel a drive motor and an actuator. The idler wheel may have a substantially rigid outer layer. The drive wheel may have a compliant outer layer and may correspond to the idler wheel. The drive motor may be operably connected to the drive wheel and may be configured to cause the drive wheel to rotate around a shaft. The actuator may be operably connected to the drive wheel and configured to cause the drive wheel to move between a closed position and an open position. The drive wheel is configured to contact a sheet in the closed position and to not contact a sheet in the open position.

7 Claims, 5 Drawing Sheets

U.S. PATENT DOCUMENTS

| | | | |
|---|---|---|---|
| 5,198,067 | A | 3/1993 | Sumi et al. |
| 5,209,465 | A | 5/1993 | Sayama et al. |
| 5,219,159 | A | 6/1993 | Malachowski et al. |
| 5,278,624 | A | 1/1994 | Kamprath et al. |
| 5,313,253 | A | 5/1994 | Martin et al. |
| 5,697,608 | A | 12/1997 | Castelli et al. |
| 5,778,300 | A | 7/1998 | Murakami et al. |
| 5,887,996 | A | 3/1999 | Castelli et al. |
| 6,007,063 | A | 12/1999 | Park |
| 6,019,365 | A | 2/2000 | Matsumura |
| 6,059,285 | A | 5/2000 | Suga et al. |
| 6,137,989 | A | 10/2000 | Quesnel |
| 6,168,153 | B1 | 1/2001 | Richards et al. |
| 6,173,952 | B1 | 1/2001 | Richards et al. |
| 6,338,483 | B1 | 1/2002 | Andela et al. |
| 6,374,075 | B1 | 4/2002 | Benedict et al. |
| 6,533,268 | B2 | 3/2003 | Williams et al. |
| 6,736,394 | B2 | 5/2004 | Herrmann et al. |
| 6,817,611 | B2 | 11/2004 | DiRamio |
| 6,860,204 | B2 | 3/2005 | Hashiguchi |
| 7,121,546 | B2 | 10/2006 | Johnson et al. |
| 7,195,238 | B2 | 3/2007 | Suga et al. |
| 7,243,917 | B2 | 7/2007 | Knierim et al. |
| 7,252,287 | B2 | 8/2007 | Tsutoh |
| 7,258,340 | B2 | 8/2007 | Clark et al. |
| 7,422,209 | B2 | 9/2008 | Hashimoto |
| 7,527,263 | B2 | 5/2009 | DeGruchy et al. |
| 7,677,558 | B2 | 3/2010 | Kinoshita et al. |
| 7,686,299 | B2 | 3/2010 | Herrmann |
| 7,819,399 | B2 | 10/2010 | Choi |
| 2003/0146567 | A1 | 8/2003 | Williams et al. |
| 2006/0071419 | A1 | 4/2006 | Lee |
| 2006/0181015 | A1 | 8/2006 | Takahashi |
| 2006/0261540 | A1 | 11/2006 | Loiselle et al. |
| 2009/0121419 | A1 | 5/2009 | deJong et al. |
| 2010/0090391 | A1 | 4/2010 | dejong et al. |
| 2010/0276873 | A1 | 11/2010 | Richards et al. |
| 2010/0327513 | A1* | 12/2010 | Richards et al. ..... 271/109 |

* cited by examiner

NIP RELEASE SYSTEM

CROSS-REFERENCE TO RELATED APPLICATIONS

This application claims priority to and is a continuation of U.S. patent application Ser. No. 12/249,593 filed Oct. 10, 2008.

Not Applicable

BACKGROUND

The present disclosure generally relates to document processing devices and methods for operating such devices. More specifically, the present disclosure relates to methods and systems for maintaining accurate alignment of an idler wheel in a releasable nip system.

Document processing devices typically include one or more sets of nips used to transport media (i.e., sheets) within the device. A nip provides a force to a sheet as it passes through the nip to propel it forward through the document processing device. Depending upon the size of the sheet that is being transported, one or more nips in a set of nips might not contact the sheet as it is being transported.

FIG. 1A depicts a top view of a portion of an exemplary document processing device known in the art. As shown in FIG. 1A, the document processing device 100 includes three sets of nips 105*a-b*, 110*a-b*, and 115*a-b*. The first set of nips 105*a-b* are used to transport a sheet; the second set of nips 110*a-b* are used to perform sheet registration; and the third set of nips 115*a-b* are used to transport a sheet in a process direction. Although two nips are shown for each set of nips, additional or fewer nips can be used. In some cases, additional nips are used to account for variations in sheet size during the transport or registration processes.

As shown in FIG. 1B, each nip in a set of nips, such as 115*a-b*, includes a drive wheel, such as 125, and an idler wheel, such as 130. A normal force is caused at each nip by loading the idler wheel 130. Friction between the sheet and each nip 115*a-b* is used to produce a normal force that propels the sheet in a process direction. Typically, each idler wheel 130 is mounted independently from the other idler wheels in a set of nips.

Transferring a sheet in the process direction to consecutive sets of nips 115*a-b* or to another station within a document processing device 100 (e.g., to receive an image from a photoreceptor) requires each nip pair to open and close. In conventional systems, the idler wheels 130 are part of a moveable mechanism connected to an actuator that opens and closes the nip. The alignment of the hard idler wheels is critical to achieving accurate and repeatable sheet motion, which is difficult to achieve in conjunction with the moveable mechanism.

SUMMARY

Before the present systems, devices and methods are described, it is to be understood that this disclosure is not limited to the particular systems, devices and methods described, as these may vary. It is also to be understood that the terminology used in the description is for the purpose of describing the particular versions or embodiments only, and is not intended to limit the scope.

It must also be noted that as used herein and in the appended claims, the singular forms "a," "an," and "the" include plural references unless the context clearly dictates otherwise. Thus, for example, reference to a "nip" is a reference to one or more nips and equivalents thereof known to those skilled in the art, and so forth. Unless defined otherwise, all technical and scientific terms used herein have the same meanings as commonly understood by one of ordinary skill in the art. Although any methods, materials, and devices similar or equivalent to those described herein can be used in the practice or testing of embodiments, the preferred methods, materials, and devices are now described. All publications mentioned herein are incorporated by reference. Nothing herein is to be construed as an admission that the embodiments described herein are not entitled to antedate such disclosure by virtue of prior invention. As used herein, the term "comprising" means "including, but not limited to."

In an embodiment, a sheet transport system may include an idler wheel having a substantially rigid outer layer, a drive wheel corresponding to the idler wheel and having a compliant outer layer, a drive motor operably connected to the drive wheel and configured to cause the drive wheel to rotate around a shaft, and an actuator operably connected to the drive wheel and configured to cause the drive wheel to move between a closed position and an open position. The drive wheel is configured to contact a sheet in the closed position and to not contact a sheet in the open position.

In an embodiment, a sheet transport system may include an idler wheel having a substantially rigid outer layer, a drive wheel corresponding to the idler wheel and having a compliant outer layer, a drive motor operably connected to the drive wheel and configured to cause the drive wheel to rotate around a shaft, and an actuator operably connected to the drive wheel and the drive motor and configured to cause the drive wheel and the drive motor to move between a closed position and an open position. The drive wheel is configured to contact a sheet in the closed position and to not contact a sheet in the open position.

In an embodiment, a method of reducing sheet skew in a sheet transport system may include automatically moving a drive wheel of a nip from an open position to a closed position, receiving a sheet at the nip, using the drive wheel to transport the sheet through the nip, and automatically moving the drive wheel from the closed position to the open position. The nip may include an idler wheel and the drive wheel. The idler wheel may include a substantially rigid outer layer. The drive wheel may include a substantially compliant outer layer. The drive wheel is configured to not contact a sheet in the open position and is configured to contact a sheet in the closed position.

BRIEF DESCRIPTION OF THE DRAWINGS

Aspects, features, benefits and advantages of the present invention will be apparent with regard to the following description and accompanying drawings, of which.

DETAILED DESCRIPTION

The following terms shall have, for the purposes of this application, the respective meanings set forth below.

A "document processing device" refers to a device that performs an operation in the course of producing, replicating, or transforming a document from one format to another format, such as from an electronic format to a physical format or vice versa. Document processing devices may include, without limitation, printers (using any printing technology, such as xerography, ink-jet, or offset); document scanners or specialized readers such as check readers; mail handling machines; fabric or wallpaper printers; or any device in which an image of any kind is created on and/or read from a moving substrate.

A "nip" refers to a location in a document processing device at which a force is applied to a sheet to propel the sheet in a process direction. A nip may include, for example and without limitation, a drive wheel and an idler wheel.

A "drive wheel" refers to a nip component that is designed to propel a sheet in contact with the nip. A drive wheel may comprise a compliant material, such as rubber, neoprene or the like. A drive wheel may be directly driven via a stepper motor, a DC motor or the like. Alternately, a drive wheel may be driven using a gear train, belt transmission or the like.

An "idler wheel" refers to a nip component that is designed to provide a normal force against a sheet in order to enable the sheet to be propelled by the drive wheel. An idler wheel may comprise a non-compliant material, such as plastic.

An "open position" refers to a state of a nip in which the drive wheel does not provide a normal force in the direction of the idler wheel. For example, in an open position, the drive wheel does not contact either a sheet received at the nip or the idler wheel (if a sheet is not present).

A "closed position" refers to a state of a nip in which the drive wheel provides a normal force in the direction of the idler wheel. For example, in a closed position, the drive wheel contacts either a sheet received at a nip or the idler wheel (if a sheet is not present).

Figure 1A:
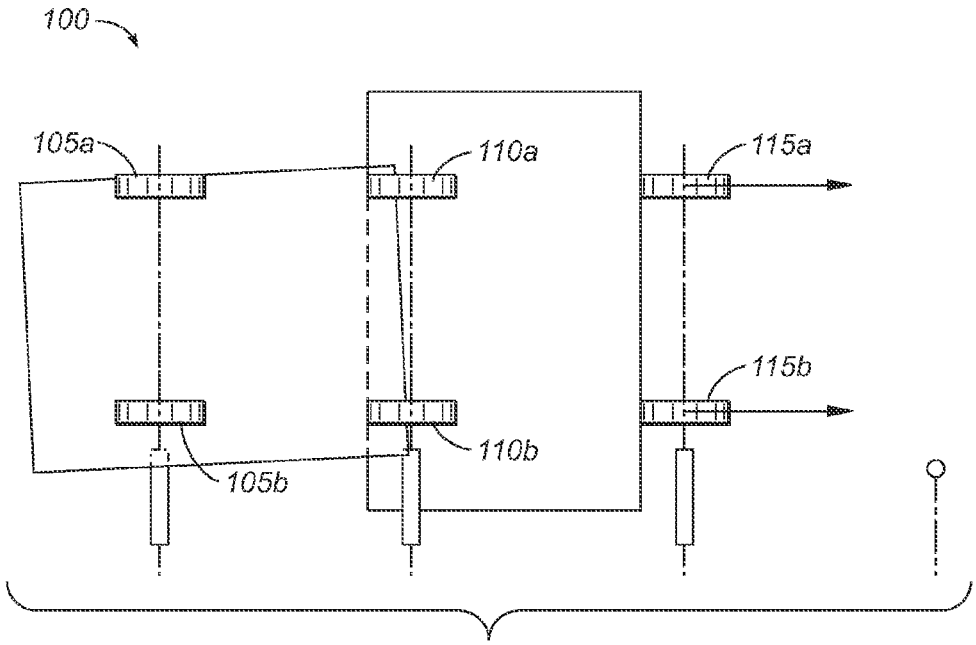
FIG. 1A (PRIOR ART)
FIG. 1A depicts a top view of a portion of a conventional document processing device.
Figure 1B:
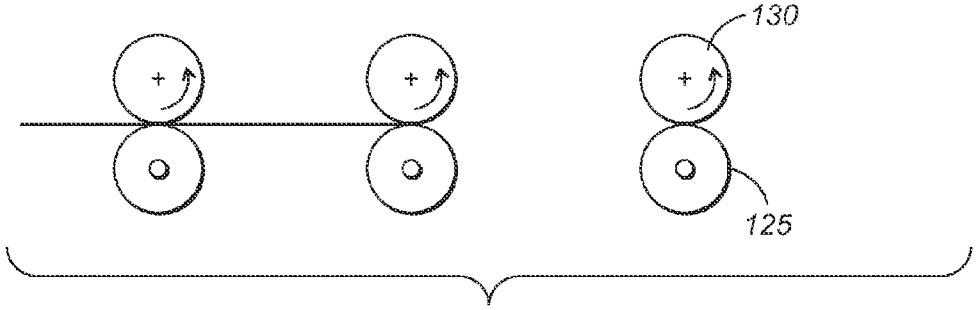
FIG. 1B (PRIOR ART)
FIG. 1B depicts a lateral view of a sheet transport system for a conventional document processing device.
Figure 2:
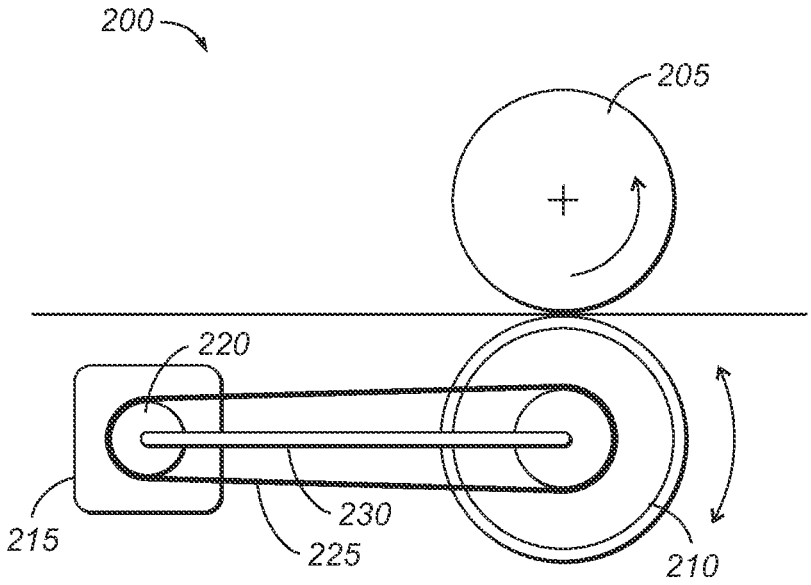
FIG. 2 depicts a lateral view of an exemplary sheet transport system for a document processing device according to an embodiment.

The present disclosure is directed to a releasable nip system that maintains alignment of idler wheels and methods of using the same. FIG. 2 depicts a lateral view of an exemplary sheet transport system for a document processing device according to an embodiment. As shown in FIG. 2, the sheet transport system 200 may include an idler wheel 205, a drive wheel 210, a drive motor 215, and an actuator 220.

The idler wheel 205 is a nip component designed to provide a normal force against a sheet that is being transported by the sheet transport system 200 in order to enable the sheet to be propelled by the drive wheel 210. The idler wheel 205 may comprise a non-compliant material, such as a hard plastic. The idler wheel 205 may rotate around a shaft (such as 415 in FIG. 4). In an embodiment, the shaft may be attached to one or more springs that provide the normal force for the idler wheel 205. Other methods of applying a normal force for the idler wheel 205 may also be used within the scope of this disclosure.

The drive wheel 210 is another nip component that is designed to propel a sheet that is being transported by the sheet transport system 200. The drive wheel 210 may comprise a compliant material, such as rubber, neoprene or the like. The drive wheel 210 may be directly driven via a drive motor 215, such as a stepper motor, a DC motor or the like. The transmission system 225, as shown in FIG. 2, may include a drive belt. However, other transmission systems 225, such as gear trains, are known to those of ordinary skill in the art and are intended to be included within the scope of this disclosure.

In an embodiment, the drive motor 215 may be placed in a location that is downstream from a location of the drive wheel 210 with respect to the process direction of the sheet to be transported. In an alternate embodiment, the drive motor 215 may be placed in a location that is upstream from a location of the drive wheel 210 with respect to the process direction of the sheet to be transported.

An actuator 220 is generally a mechanical device used to move or control a mechanism or system. The actuator 220 in FIG. 2 may be used to move or control the location of the drive wheel 210 with respect to a sheet that is transported by the sheet transport system 200. As shown in FIG. 2, the actuator 220 may be operably connected to a pivot arm 230, which is in turn operably connected to the drive wheel 210. In an embodiment, when the nip is desired to be opened, the actuator 220 may cause the pivot arm 230 to rotate or otherwise move away from the idler wheel 205, which, in turn, may cause the drive wheel 210 to be rotated or moved from a closed position to an open position. Conversely, when the nip is desired to be closed, the actuator 220 may cause the pivot arm 230 to rotate or otherwise move toward the idler wheel 205, which may cause the drive wheel 210 to be rotated or moved from the open position to the closed position.

In an embodiment, the actuator 220 may be attached to the drive motor 215. In an embodiment, the actuator 220 may be integral to the drive motor 215.

Figure 3:
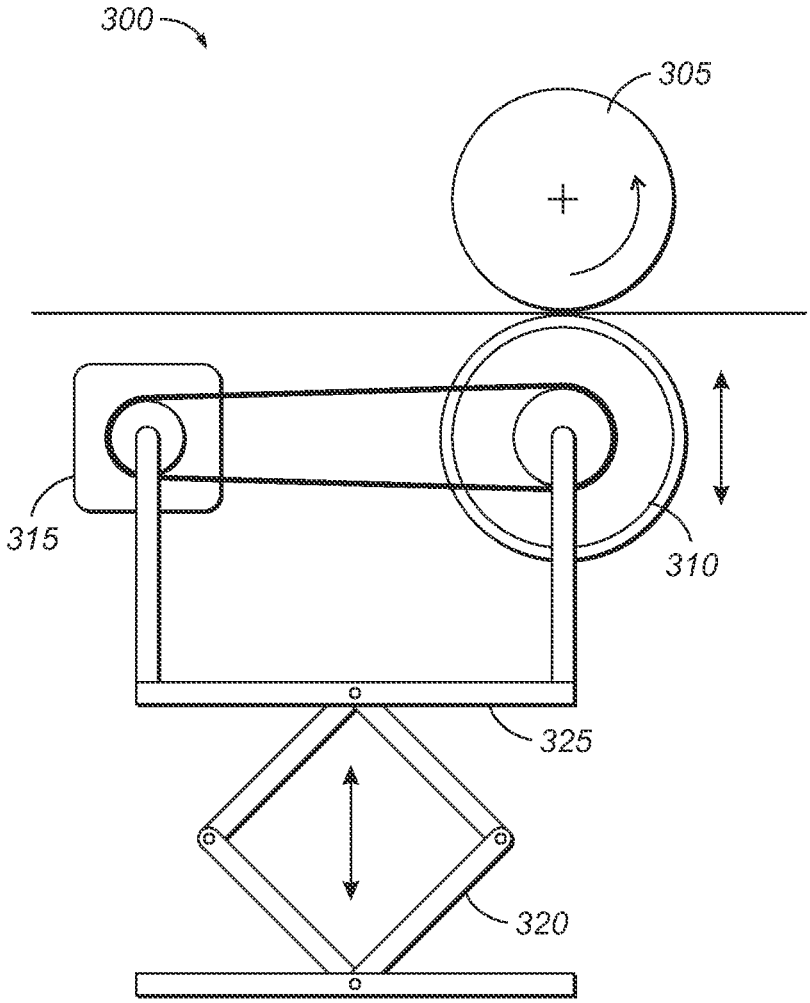
FIG. 3 depicts an alternate exemplary sheet transport system for a document processing device according to an embodiment.

FIG. 3 depicts an alternate exemplary sheet transport system for a document processing device according to an embodiment. As shown in FIG. 3, the sheet transport system 300 may include an idler wheel 305, a drive wheel 310, a drive motor 315, and an actuator 320. As shown, the actuator 320 may be separate from the drive motor 315. For example, the actuator 320 may be used to move the drive wheel 310 and the drive motor 315 towards or away from the idler wheel 305. In such an embodiment, the drive wheel 310 and the drive motor 315 may be positioned in a fixed relationship with respect to each other. For example, the drive wheel 310 and the drive motor 315 may be operably connected to a platform 325 that moves away from or towards the idler wheel 305 as controlled by the actuator 320. In an embodiment, the actuator 320 may cause the drive wheel 310 and the drive motor 315 to rotate away from or towards the idler wheel 305. In an embodiment, the pivot point around which the drive wheel 310 and the drive motor 315 rotate may be the center of the drive motor in order to minimize the moment of inertia.

Figure 4:
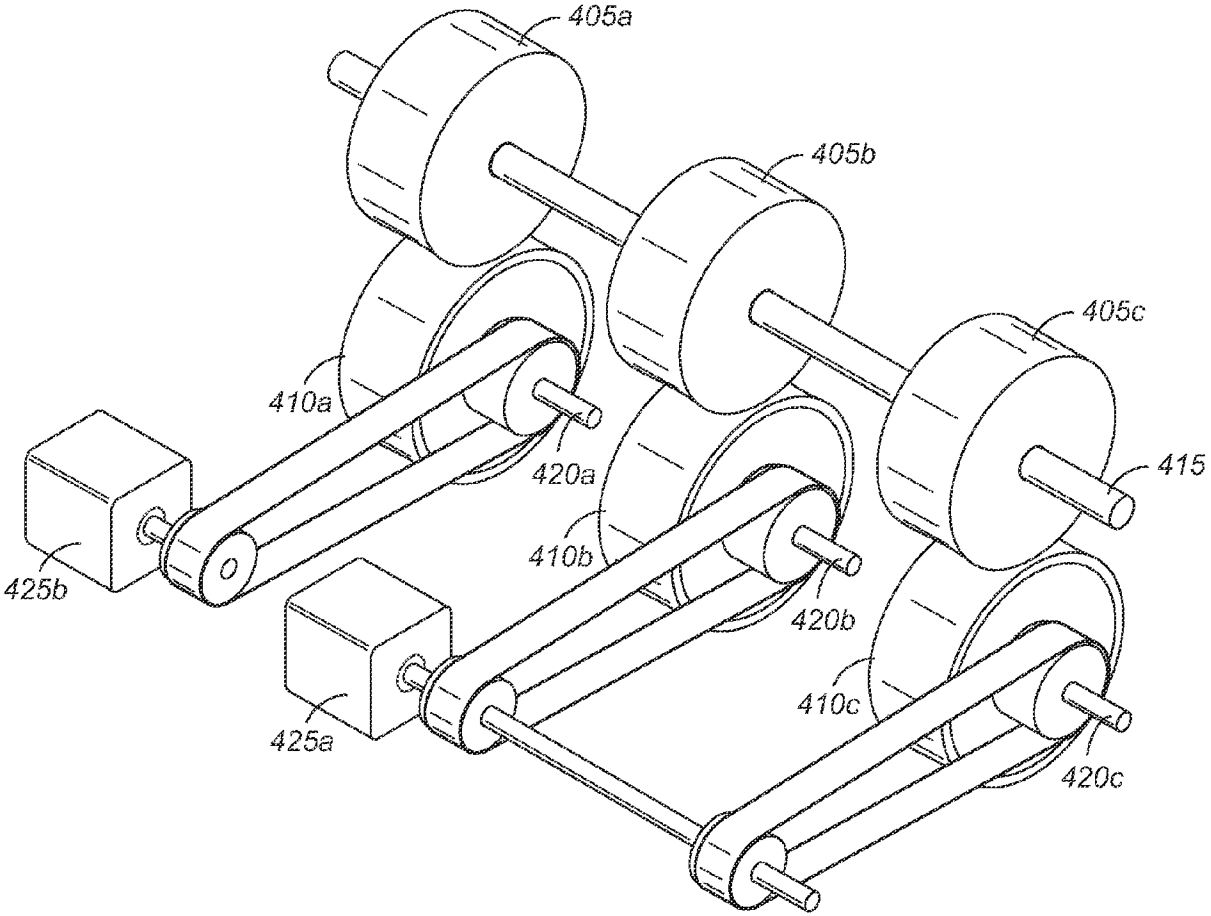
FIG. 4 depicts an exemplary sheet transport system for a document processing device according to an embodiment.

FIG. 4 depicts an exemplary sheet transport system for a document processing device according to an embodiment. As shown in FIG. 4, a sheet transport system may include a plurality of nips (i.e., corresponding pairs of idler wheels 405*a-c* and drive wheels 410*a-c*). In an embodiment, the idler wheels 405*a-c* may be located on a common shaft 415 around which each idler wheel rotates.

In an embodiment, each drive wheel 410*a-c* may be located on a separate shaft 420*a-c*. In an embodiment, each shaft 420*a-c* may be operably connected to a separate actuator. As such, each drive wheel 410*a-c* may be moved into an open position or a closed position independently of the other drive wheels. In an alternate embodiment, a single actuator may be used to move a plurality of shafts 420*a-c* independently. In yet another embodiment, a single actuator may be used to move a plurality of shafts 420*a-c* simultaneously.

In an embodiment, a plurality of drive wheels, such as 410*a* and 410*b* as shown in FIG. 4, may be driven by a first drive motor 425*a*. In an embodiment, one or more drive wheels, such as 410*c*, may additionally be driven by a second drive motor 425*b*.

Figure 5:
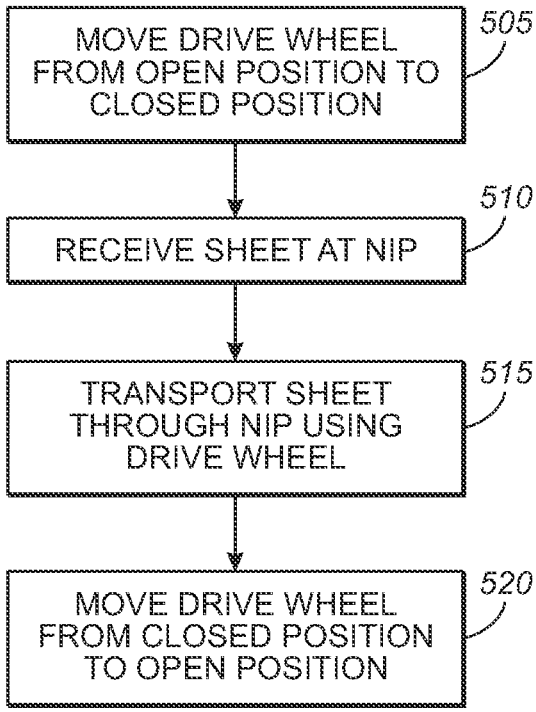
FIG. 5 depicts a flow diagram for an exemplary method of reducing sheet skew in a sheet transport system according to an embodiment.

FIG. 5 depicts a flow diagram for an exemplary method of reducing sheet skew in a sheet transport system having at least one pair of idler wheels according to an embodiment. As shown in FIG. 5, a drive wheel of a nip may be moved 505 from an open position in which the drive wheel cannot contact a sheet to a closed position in which the drive wheel can contact a sheet. The nip includes an idler wheel and the drive wheel. The idler wheel has a substantially rigid outer layer, such as a hard plastic. The drive wheel has a substantially compliant outer layer, such as rubber, neoprene or the like. The sheet may include any media upon which a physical representation of an image may be printed or has been printed. In an embodiment, the drive wheel may be moved 505 into a closed position prior to receiving a sheet to enable the sheet to be transported through the nip. In an embodiment, the drive wheel may be moved 505 automatically in response to, for example, sensor detection of a leading edge of a sheet as it approached the nip. Other methods for determining when to move 505 the drive wheel to the closed position are likewise intended to be included within the scope of this disclosure.

A sheet may be received 510 at a nip when the drive wheel is in the closed position. The drive wheel may be used to transport 515 the sheet through the nip. For example, the drive wheel may transport 515 the sheet by rotating while in contact with the sheet to cause the sheet to be propelled in a process direction. The idler wheel may also be in contact with the sheet and may provide a normal force in the direction of the drive wheel to ensure contact between the sheet and the drive wheel.

When the sheet has been transported through the nip (or at least transported sufficiently such that it may be further transported by an adjacent nip or other transporting device), the drive wheel may be automatically moved 520 from the closed position to the open position. Moving 520 the drive wheel into the open position may reduce drag on the sheet and wear on the nip components.

It will be appreciated that various of the above-disclosed and other features and functions, or alternatives thereof, may be desirably combined into many other different systems or applications. It will also be appreciated that various presently unforeseen or unanticipated alternatives, modifications, variations or improvements therein may be subsequently made by those skilled in the art which are also intended to be encompassed by the disclosed embodiments.

What is claimed is:

1. A sheet transport system, comprising:

a first idler wheel having a substantially rigid outer layer;

a first drive wheel having a compliant outer layer, wherein the first drive wheel corresponds to the first idler wheel;

a drive motor operably connected to the first drive wheel, wherein the drive motor is configured to cause the first drive wheel to rotate around a first shaft; and a first actuator operably connected to the first drive wheel and the drive motor, wherein the first actuator is configured to cause the first drive wheel and the drive motor to move between a closed position and an open position, wherein the first drive wheel is configured to contact a sheet in the closed position and to not contact a sheet in the open position.

2. The sheet transport system of claim 1 wherein the first actuator is further configured to move the first drive wheel and the drive motor a substantially equal distance when causing the first drive wheel and the drive motor to move between a closed position and an open position.

3. The sheet transport system of claim 1 wherein the first actuator is operably connected to a platform, and the platform is configured to move toward or away from the first idler wheel such that the first drive wheel and the drive motor move between a closed position and an open position.

4. The sheet transport system of claim 1, further comprising:

a second idler wheel having a substantially rigid outer layer; and a second drive wheel having a compliant outer layer, wherein the second drive wheel corresponds to the second idler wheel, wherein the drive motor is further configured to cause the second drive wheel to rotate.

5. The sheet transport system of claim 4 wherein the drive motor is further configured to cause the second drive wheel to rotate around a second shaft.

6. The sheet transport system of claim 5 wherein a second drive motor is configured to cause a third drive wheel to rotate around a third shaft.

7. The sheet transport system of claim 1, further comprising:

a second idler wheel having a substantially rigid outer layer;

a second drive wheel having a compliant outer layer, wherein the second drive wheel corresponds to the second idler wheel; and a second actuator operably connected to the second drive wheel, wherein the second actuator is configured to cause the second drive wheel to move between a closed position and an open position, wherein the second drive wheel is configured to contact a sheet in the closed position and to not contact a sheet in the open position, wherein the drive motor is further configured to cause the second drive wheel to rotate.

* * * * *